US006655347B2

(12) United States Patent
Takamiya et al.

(10) Patent No.: US 6,655,347 B2
(45) Date of Patent: Dec. 2, 2003

(54) INTAKE PORT OF INTERNAL COMBUSTION ENGINE

(75) Inventors: Fumio Takamiya, Mishima (JP); Takeshi Okumura, Susono (JP); Shikio Katayama, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/383,067

(22) Filed: Mar. 7, 2003

(65) Prior Publication Data

US 2003/0168040 A1 Sep. 11, 2003

(30) Foreign Application Priority Data

Mar. 11, 2002 (JP) ..... 2002-065739
Feb. 13, 2003 (JP) ..... 2003-035275

(51) Int. Cl.[7] ..... F02B 31/04
(52) U.S. Cl. ..... 123/306; 123/301
(58) Field of Search ..... 123/306, 308, 123/301, 432

(56) References Cited

U.S. PATENT DOCUMENTS 4,516,544 A * 5/1985 Okumura et al. ..... 123/308
4,641,617 A * 2/1987 Aoyama et al. ..... 123/306
5,359,972 A * 11/1994 Isaka ..... 123/308

FOREIGN PATENT DOCUMENTS

JP A 8-042390 * 2/1996
JP A 11-036876 * 2/1999
WO WO 01/57376 A1 * 8/2001

* cited by examiner

*Primary Examiner*—Erick Solis
(74) *Attorney, Agent, or Firm*—Oliff & Berridge, PLC

(57) ABSTRACT

An intake port of an internal combustion engine having an intake passage curved to a certain direction and communicated with a combustion chamber of the engine to send air into the combustion chamber, provided with a groove provided in a wall at a side near a center of curvature of said intake passage in the wall defining the intake passage and extending along the flow of air in the intake passage, at least one long edge formed by one side wall of the wall defining said groove and the wall adjoining said side wall in the wall defining the intake passage, extending along the flow of air in the intake passage, and projecting out toward the inside of the intake passage, and a bent part provided at the wall of the side near the center of curvature of the intake passage in the wall defining the intake passage in proximity to a line connecting the intake passage and combustion chamber and extending in a horizontal direction with respect to the flow of air in the intake passage.

6 Claims, 10 Drawing Sheets

INTAKE PORT OF INTERNAL COMBUSTION ENGINE

BACKGROUND OF THE INVENTION

1. Field of the Invention

The present invention relates to an intake port of an internal combustion engine (hereinafter referred to as an "engine").

2. Description of the Related Art

In direct injection type engines which directly inject fuel into the combustion chamber from a fuel injector, it is known to improve the degree of mixing of the fuel and air in the combustion chamber by making the air flow into the combustion chamber so that it swirls in the chamber. This type of engine is disclosed in Japanese Unexamined Patent Publication (Kokai) No. 8-42390.

In the above direct injection type engine, however, the greater the number of times the air swirls in the combustion chamber per unit engine speed (hereinafter referred to as the "intake swirl ratio"), the higher the degree of mixing in the combustion chamber. Therefore, in Japanese unexamined Patent Publication (Kokai) No. 8-42390, to increase the intake swirl ratio as much as possible, the wall of the engine defining the intake port is given an edge extending in a direction perpendicular to the air flowing through the intake port, that is, in the horizontal direction with respect to the air flowing through the intake port. Japanese Unexamined Patent Publication (Kokai) No. 8-42390 explains that this edge causes the air to concentrate at a specific region and then flow into the combustion chamber, so the intake swirl ratio becomes larger.

In this way, in direct injection type engines, there are demands for increasing the intake swirl ratio as much as possible. In general, however, if increasing the intake swirl ratio by causing the air to concentrate at a specific region as explained above, part of the space in the intake port near the combustion chamber will no longer be able to be used for the flow of air. The total amount of the air taken into the combustion chamber will therefore end up being reduced by the amount of that space. That is, increasing the intake swirl ratio and increasing the total amount of the air taken into the combustion chamber are generally contradictory.

SUMMARY OF THE INVENTION

An object of the present invention is to increase the swirl ratio of air taken into the combustion chamber of an engine chamber as much as possible while maintaining a large total amount of air taken into the chamber.

To attain the above object, according to a first aspect of the present invention, there is provided an intake port of an internal combustion engine having an intake passage curved to a certain direction and communicated with a combustion chamber of the engine to send air into the combustion chamber, provided with a groove provided in a wall at a side near a center of curvature of said intake passage in the wall defining the intake passage and extending along the flow of air in the intake passage, at least one long edge formed by one side wall of the wall defining said groove and the wall adjoining said side wall in the wall defining the intake passage, extending along the flow of air in the intake passage, and projecting out toward the inside of the intake passage, and a bent part provided at the wall of the side near the center of curvature of the intake passage in the wall defining the intake passage in proximity to a line connecting the intake passage and combustion chamber and extending in a horizontal direction with respect to the flow of air in the intake passage.

According to this, due to the provision of the long edge, the total amount of air taken into the combustion chamber becomes greater. Further, since the intake passage is communicated with the combustion chamber while being curved in a certain direction, the air flowing through the inside of the intake passage flows into the combustion chamber while being concentrated at a specific region and swirls in the combustion chamber. Since the bent part is provided, the air flowing through the intake passage flows into the combustion chamber while being further concentrated at a specific region, so more powerfully swirls in the combustion chamber. That is, the swirl ratio of the air in the combustion chamber becomes larger.

Preferably, the bent part is formed by the boundary of said groove at the combustion chamber side.

Preferably, the at least one long edge comprises two long edges formed by the two side walls in the wall defining the groove and the walls adjoining these side walls in the wall defining the intake passage, extending along the flow of air in the intake passage, and projecting out toward the inside of the intake passage. The distance between the long edges at the side near the combustion chamber is longer than the distance between these long edges at the side far from the combustion chamber.

Preferably, the bottom wall in the wall defining the groove is flat.

Preferably, at least part of the wall at the side far from the center of curvature of the intake passage in the wall defining the intake passage is flat.

According to a second aspect of the present invention, there is provided an intake port having an intake passage for sending air into a combustion chamber of an internal combustion engine and having a long axis of said intake passage extending toward a partial region of the intake port of the combustion chamber opening when an intake valve opens, provided with a groove provided in the wall of a side different from a wall facing the partial region of said intake port when viewed along a long axis of said intake passage in the wall defining the intake passage and extending along the flow of air in the intake passage, a long edge formed by one side wall of the wall defining the groove and the wall adjoining said side wall in the wall defining the intake passage, extending along the flow of air in the intake passage, and projecting out toward the inside of the intake passage, and a bent part provided at the wall of the side where said long edge is provided in the wall defining the intake passage in proximity to a line connecting the intake passage and combustion chamber and extending in a horizontal direction with respect to the flow of air in the intake passage.

According to this, due to the provision of the long edge, the total amount of air taken into the combustion chamber becomes greater. Further, since the long axis of the intake passage extends toward a partial region of the intake port of the combustion chamber when the intake valve is opened, the air flowing through the inside of the intake passage flows into the combustion chamber while being concentrated at a specific region and swirls in the combustion chamber. Since the bent part is provided, the air flowing through the intake passage flows into the combustion chamber while further being concentrated at a specific region, so more powerfully swirls in the combustion chamber. That is, the swirl ratio of the air in the combustion chamber becomes larger.

BRIEF DESCRIPTION OF THE DRAWINGS

The present invention may be more fully understood from the description of the preferred embodiments of the invention set forth below together with the accompanying drawings, in which.

DESCRIPTION OF THE PREFERRED EMBODIMENTS

Figure 1:
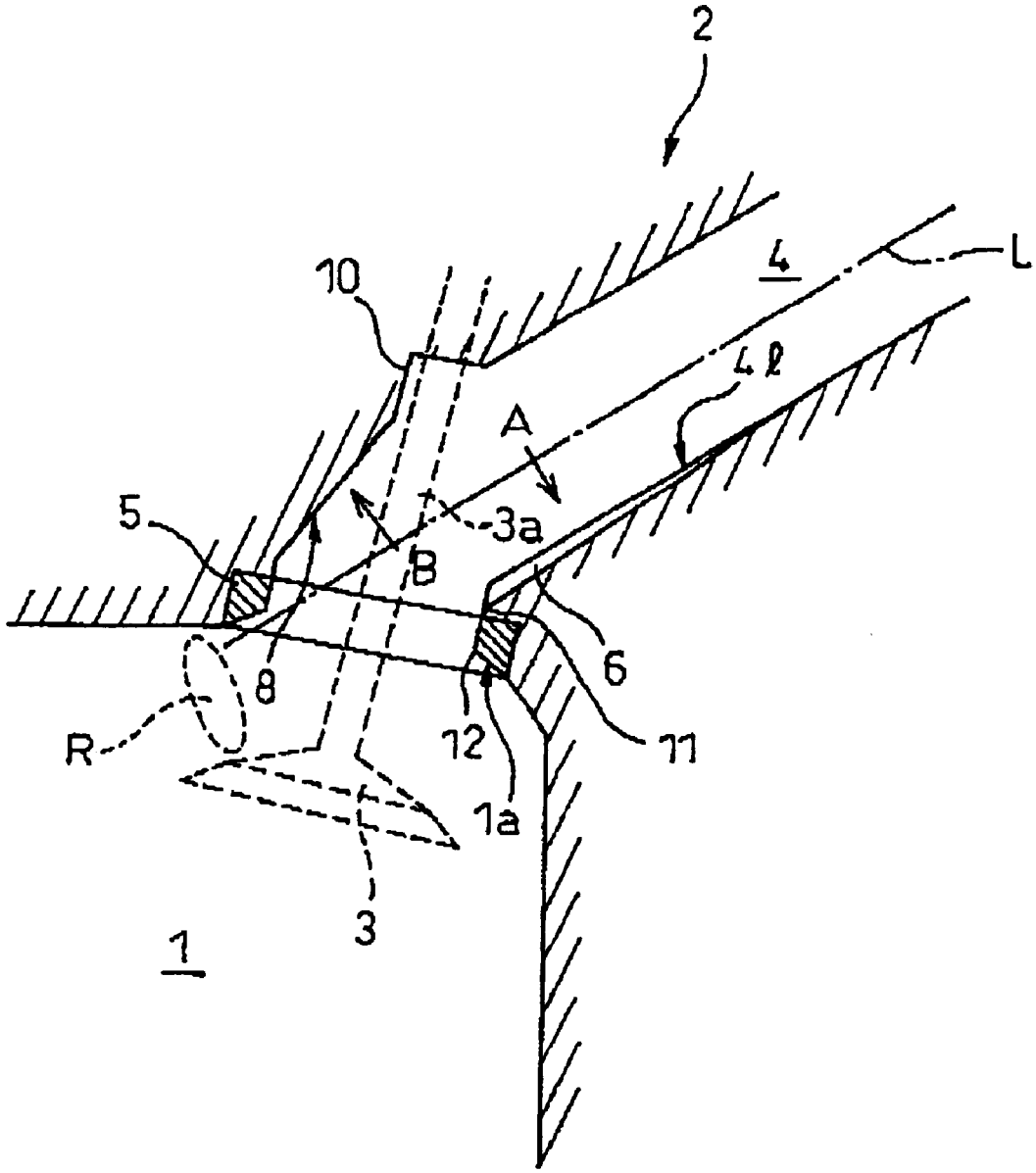
FIG. 1 is a cross-sectional view of an intake port according to an embodiment of the present invention.

Preferred embodiments of the present invention will be described in detail below while referring to the attached figures. In FIG. 1, reference numeral 1 is a combustion chamber of an engine, 2 is an intake port, and 3 is an intake valve. In the following explanation, the engine is a compression ignition type engine. In this engine, fuel is directly injected to the combustion chamber 1 from a fuel injector (not shown). Note that the present invention can also be applied to a spark ignition type of a direct injection type engine where the fuel is directly injected from a fuel injector to a combustion chamber.

The intake port 2 has an intake passage 4. The intake passage 4 is communicated with the combustion chamber 1. In the illustrated embodiment, a valve seat ring 5 for seating the intake valve 3 is placed between the intake passage 4 and the combustion chamber 1, but in the explanation of the present embodiment, the intake passage 4 of the intake port 2 is considered to include the opening 6 of the valve seat ring 5.

The intake passage 4 extends relatively straight up until near the combustion chamber 1, then is curved in a certain direction near the combustion chamber 1 to reach the combustion chamber 1. More specifically, the wall 41 of the side near the center of curvature of the intake port 4 in the wall defining the intake port 4 extends relatively straight up until near the combustion chamber 1 and curves near the combustion chamber 1. On the other hand, the wall 4*u* at the side far from the center of curvature of the intake port 4 also extends relatively straight up until near the combustion chamber 1, but starts to curve from a location farther from the combustion chamber 1 than the wall 41.

Explaining this in another way, the intake port 4 extends relatively straight toward the combustion chamber 1 and then curves relatively rapidly so as to be bent near the combustion chamber 1 and communicate with the combustion chamber 1. Explaining this is still another way, the intake port 4 is communicated with the combustion chamber while being curved in a certain direction. Explaining this in still another way, the long axis L of the intake port 4 extends toward a partial region R of the intake opening 1*a* of the combustion chamber 1 opening when the intake valve 3 opens. Note that in FIG. 1, reference numeral 10 is a stem guide seat for guiding a stem 3*a* of the intake valve 3.

Figure 2:
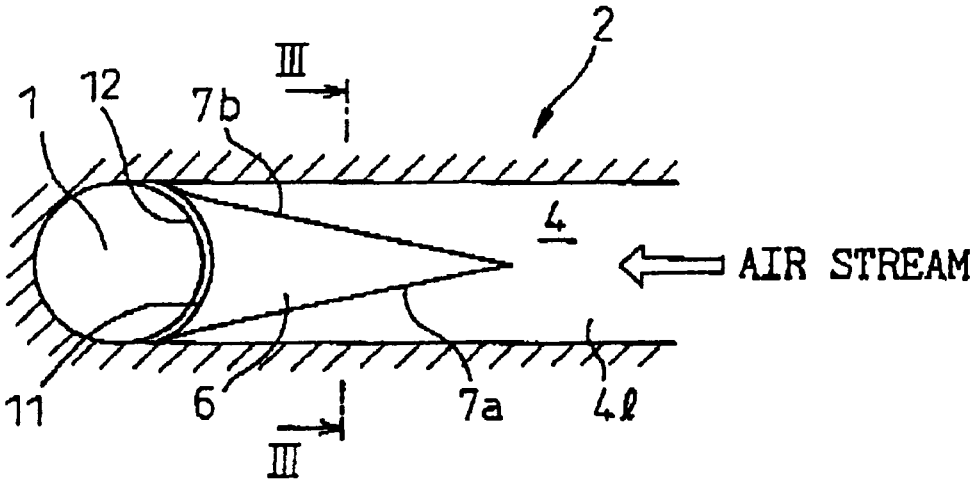
FIG. 2 is a view seen along the arrow A of FIG. 1.
Figure 3:
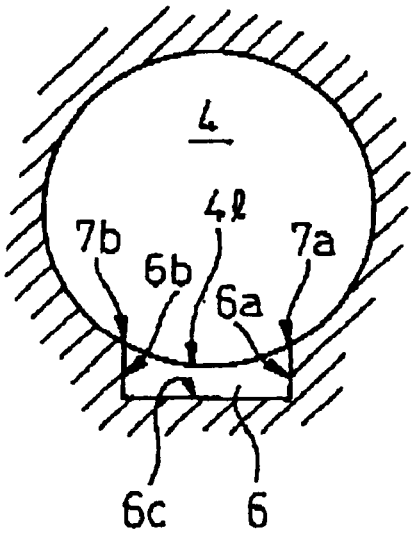
FIG. 3 is a cross-sectional view seen along the line III—III of FIG. 2.

A groove 6 is provided at the wall 41 of the side near the center of curvature of the intake port 4, that is, the wall 41 extending relatively straight, explained in another way, the wall 41 of the side different from the wall heading toward the partial region R of the intake opening la of the combustion chamber 1 when viewed along the long axis L of the intake port 4. As shown in FIG. 2, a view seen from the arrow A of FIG. 1, the groove 6 extends along the flow of air in the intake port 4. Further, as shown in FIG. 3, a cross-sectional view seen along line III—III of FIG. 2, a long edge 7*a* is formed by one side wall 6*a* of the wall defining the groove 6 and the wall adjoining the side wall 6*a* of that side in the wall defining the intake port 4. On the other hand, a long edge 7*b* is formed by the other side wall 6*b* positioned at an opposite side to that one side wall 6*a* in the wall defining the groove 6 and .the wall adjoining that other side wall 6*b* in the wall defining the intake port 4.

These long edges 7*a* and 7*b* project toward the inside of the intake port 4. In other words, the front ends of these long edges 7*a* and 7*b* are not rounded, but sharply stick out. Further, the bottom wall 6c in the wall defining the groove 6 is a flat wall.

Further, as shown in FIG. 2, the distance between the long edges 7*a* and 7*b* at the side close to the combustion chamber 1 is longer than the distance between the long edges 7*a* and 7*b* at the side far from the combustion chamber 1. More specifically, the distance between the long edges 7*a* and 7*b* becomes gradually longer the closer to the combustion chamber 1. That is, the width of the groove 6 becomes gradually larger the closer to the combustion chamber 1. Therefore, the groove 6, if viewed from FIG. 2, forms a substantially triangular shape. Further, as shown in FIG. 1, the depth of the groove 6 at the side close to the combustion chamber 1 is greater than the depth of the groove 6 at the side far from the combustion chamber 1. More specifically, the depth of the groove 6 becomes gradually greater the closer to the combustion chamber 1.

Further, in the present embodiment, at the intake passage 4 side from the line 12 connecting the intake port 4 and the combustion chamber 1 close to the line 12, the wall defining the intake port 4 is bent by curving in the direction of curvature of the intake port 4. Due to this, a bent part 11 is formed. In the present embodiment, the bent part 11 is formed by the boundary of the groove 6 of the combustion chamber 1 side. Further, the bent part 11 extends so as to transverse the flow of the air through the inside of the intake port 4. The two walls adjoining the bent part 11 form surfaces which air flowing through the inside of the intake port 4 strikes.

The bent part 11 extends over a length of at least one-quarter to not more than one-half of the inner circumferential wall of the intake port 4. Further, the angle formed by the two walls adjoining across the bent part 11 is given almost no roundness and projects out sharply (of course, if giving a similar action to the later mentioned action of the bent part of this shape, some roundness may be given). In the following explanation, this bent part is called the "transverse edge". Note that the transverse edge 11 illustrated is substantially linear in shape, but for example it may also be shaped as an arc centered at the center line of the inner circumferential wall of the intake port 4.

Figure 4:
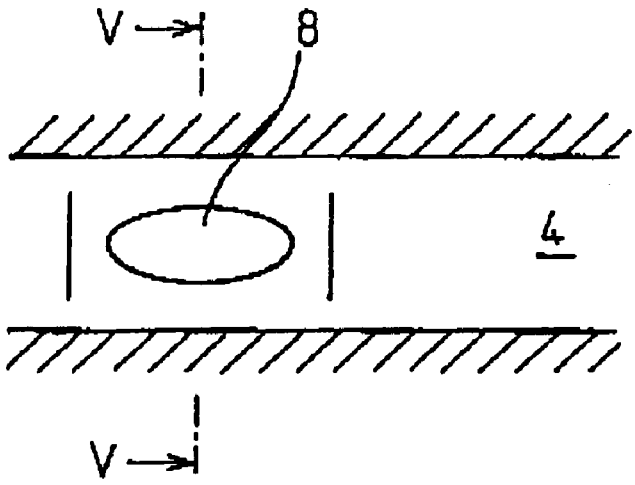
FIG. 4 is a view seen along the arrow B of FIG. 1.
Figure 5:
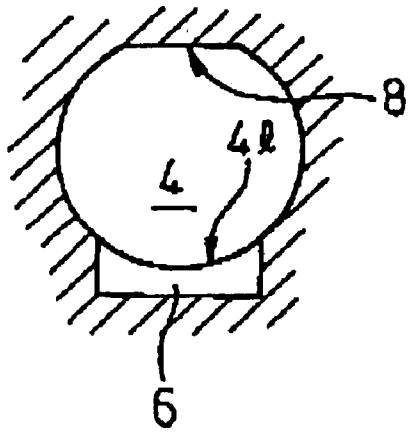
FIG. 5 is a cross-sectional view seen along the line V—V of FIG. 4.

Further, as shown in FIG. 4, which is a view seen along the arrow B of FIG. 1, and FIG. 5, which is a view seen along the line V—V of FIG. 4, part of the wall at the side far from the center of curvature of the intake port 4 in the wall defining the intake port 4 is made a flat wall 8. Here, the region occupied by the flat wall 8 is freely determined considering the flow characteristics of the air taken into the combustion chamber 1. In the present embodiment, the region occupied by the flat wall 8 is an oval shaped region from the stem guide seat 10 to the valve stem guide 5.

Figure 6:
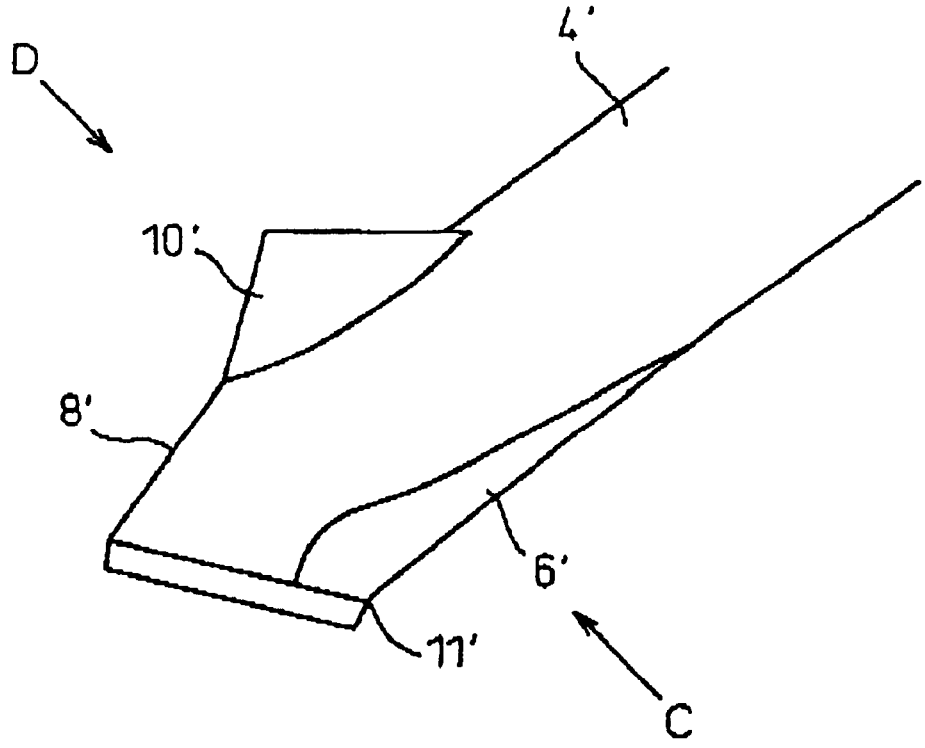
FIG. 6 is a view of a mandrel used for forming the intake port according to an embodiment of the present invention.
Figure 7:
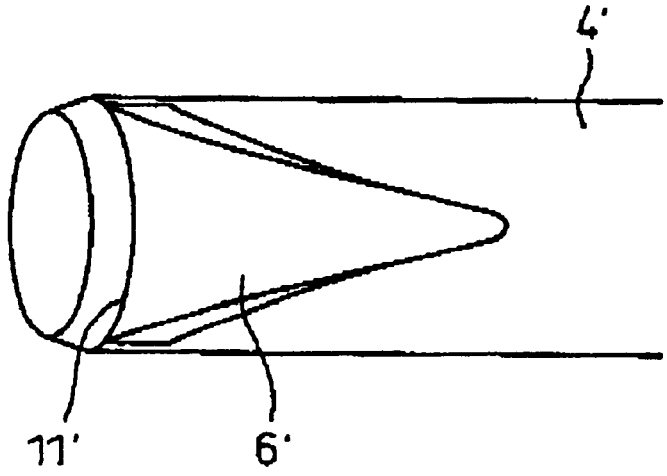
FIG. 7 is a view seen along the arrow C of FIG. 6.
Figure 8:
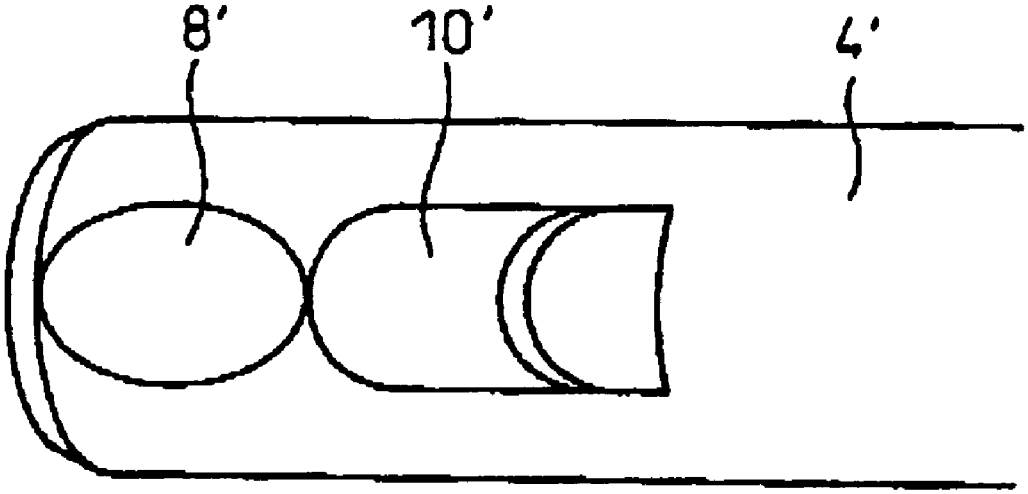
FIG. 8 is a view seen along the arrow D of FIG. 6.

Further, to facilitate understanding of the shape of the intake port of the present embodiment, FIG. 6 to FIG. 8 show an example of a mandrel used for forming the intake port according to the present embodiment. FIG. 6 is a view of the mandrel seen from the side corresponding to FIG. 1, FIG. 7 is a view of the mandrel seen along the arrow C of FIG. 7, and FIG. 8 is a view of the mandrel seen along the arrow D of FIG. 6'. In FIG. 6 to FIG. 8, the intake port 4 is formed by the part 4' of the mandrel, the groove 6 is formed by the part 6', the flat wall 8 is formed by the part 8', the stem guide seat 10 is formed by the part 10', and the transverse edge 11 is formed by the part 11'.

Next, the action of the intake port of the present embodiment will be explained. The long edges 7*a* and 7*b* create small disturbances in the flow of air in the groove 6 and its surroundings, Along with this, the pressure in the groove 6 and its surroundings falls and a force pulling in the air (pull-in force) is caused. Due to this pull-in force, the air flowing inside the intake port 4 is pulled in the direction of the groove 6, so the amount of the air flowing through the groove 6 etc. increases. Overall, the amount of the air flowing through the inside of the intake port 4, that is, the amount of the air flowing into the combustion chamber 1, increases.

Figure 9A:
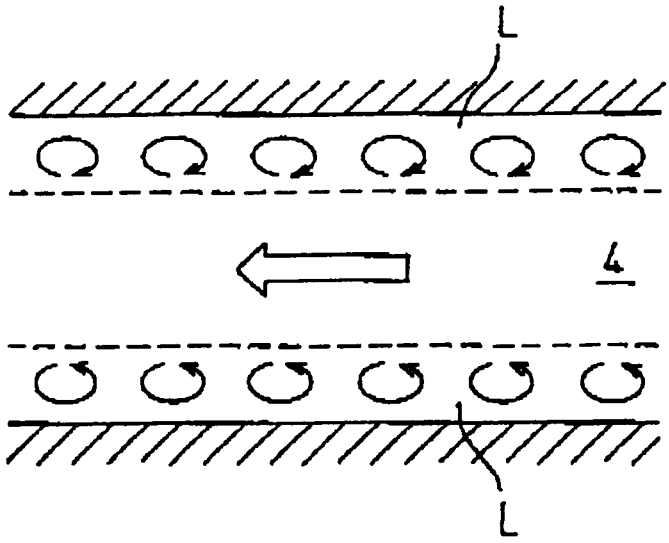
FIGS. 9A and 9B are views of the flow of air through the inside of the intake port.
Figure 9B:
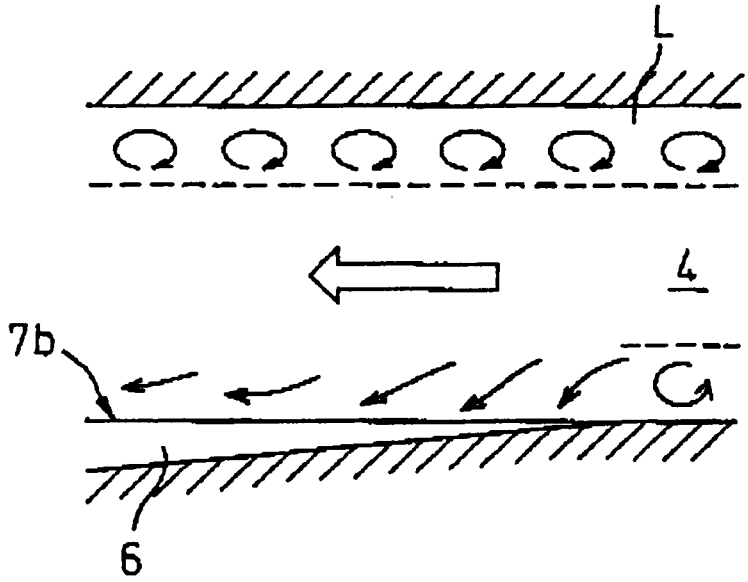

Further, as shown in FIG. 9A, when air is flowing inside the intake port 4 of a conventional intake port, a layer L where air stagnates without flowing (hereinafter called a "stagnant layer") is formed along the wall of the intake port 4. If a stagnant layer L is formed in the intake port 4 in this way, the area of the intake port 4 through which air can substantially flow becomes narrower. Therefore, in this case, the amount of the air flowing into the combustion chamber 1 becomes smaller. If however there are long edges 7*a* and 7*b* present at the wall of the intake port 4 as with the intake of the present embodiment, as shown in FIG. 9B, the stagnant layer L is destroyed by these long edges 7*a* and 7*b*, so the area of the intake port 4 through which air can substantially flow becomes greater. Therefore, with this as well, the amount of the air flowing to the combustion chamber 1 is increased.

Figure 10:
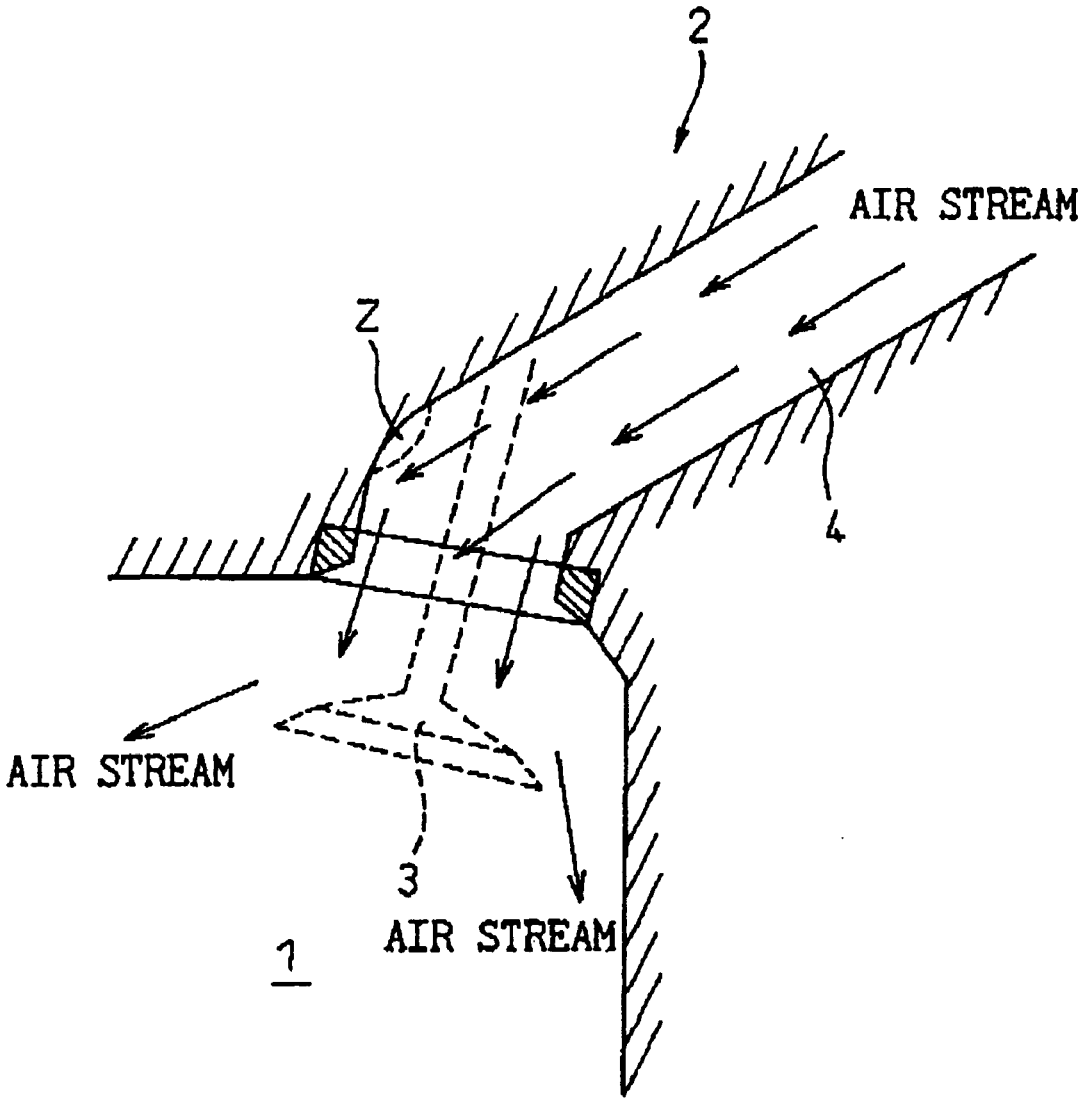
FIG. 10 is a view of the flow of air through the inside of a conventional intake port.
Figure 11:
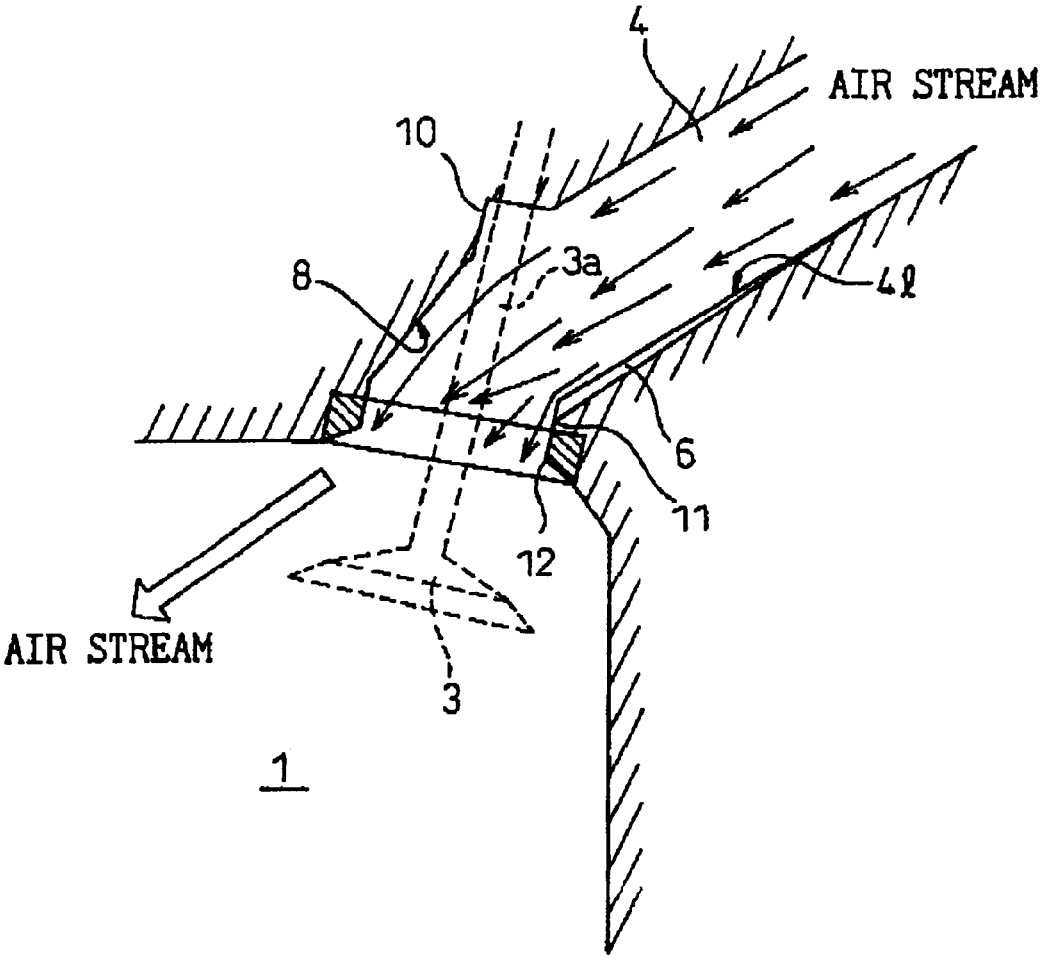
FIG. 11 is a view of the flow of air through the inside of an intake port according to an embodiment of the present invention.

Further, as shown in FIG. 10, in a conventional intake port, a part where air stagnates is formed at a region near the wall curved the most (hereinafter called the "most curved wall") in the wall at the side far from the center of curvature of the intake passage (hereinafter called the "outside curvature wall"), that is, the region Z of FIG. 10. This stagnation of the air ends up obstructing the flow of air. As opposed to this, as shown in FIG. 11, in the intake port 2 of the present embodiment, since the most curved wall 8 of the intake port 4 is a flat wall, no part where air stagnates is formed near the most curved wall 8 and the flow of air near the most curved wall 8 is not obstructed much at all. Therefore, with this as well, the amount of air flowing into the combustion chamber 1 is increased.

In this way, according to the present embodiment, due to the action of the long edges 7*a* and 7*b* and the flat wall 8, the amount of the air flowing into the combustion chamber 1 can be increased.

Figure 12A:
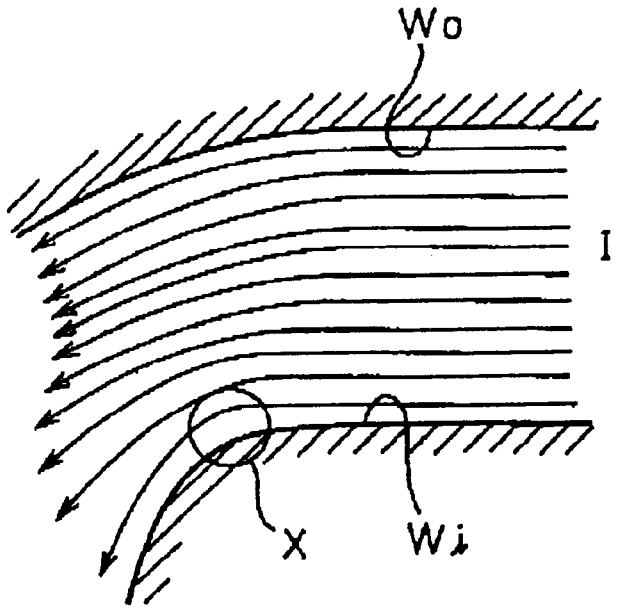
FIGS. 12A and 12B are views for explaining the action of a transverse edge according to an embodiment of the present invention.

Further, as shown in FIG. 12A, when the intake port 1 is curved with roundness in a certain direction, seen overall, the air flows into the combustion chamber in a manner concentrated at a partial region, so flows along the wall of the cylinder head defining part of the combustion chamber 1, flows along the wall of the cylinder defining another part of the combustion chamber 1 toward the piston, flows along the wall of the top of the piston, and flows along the cylinder wall toward the wall of the cylinder head, that is, swirls inside the combustion chamber 1 by a so-called "tumble flow". In the example shown in FIG. 12A, however, there is air flowing into the combustion chamber 1 by flowing along the wall Wi at the side near the center of curvature of the intake passage 1 (hereinafter called the "inside curvature wall") in the wall defining the intake port I. This flow of air flows into the combustion chamber in a direction canceling out this tumble flow. Therefore, in the example shown in FIG. 12A, the number of times of swirling of the air per unit engine speed, that is, the intake swirl ratio, is small.

Figure 12B:
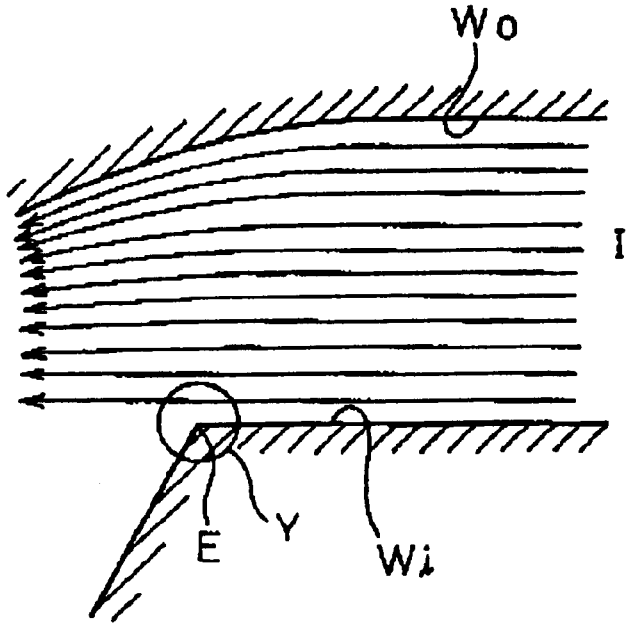

As opposed to this, as shown in FIG. 12B, if a transverse edge E extending in a horizontal direction with respect to the flow of air inside the intake port I is formed at the inside curvature wall Wi, the air peels away from the inside curvature wall Wi at the transverse edge E and as a result heads toward the outside curvature wall Wo in the wall defining the intake port I. The example shown in FIG. 12B is that of the present embodiment. According to the present embodiment, when air flows into the combustion chamber 1, it flows inside it in a manner concentrated locally, so the air swirls inside the combustion chamber 1 by a tumble flow and the intake swirl ratio is also large.

Of course, in the present embodiment, since the intake port 4 reaches the combustion chamber 1 while curving in a certain direction overall, due to this, again, the air flows into the combustion chamber 1 in a manner further locally concentrated, so the intake swirl ratio becomes even larger.

Further, in the present embodiment, since the bottom wall of the groove 6 provided in the inside curvature wall of the intake port 4 is a flat wall, the air flowing along the inside curvature wall of the intake port can easily peel away from it and as a result head toward the outside curvature wall of the intake port 4. Due to this as well, again, the air flows into the combustion chamber 1 in a manner further locally concentrated, so the intake swirl ratio becomes even larger.

Further, as shown in FIG. 10, in a conventional intake port, the region near the most curved wall in the outside curvature wall of the intake port 4, that is, the region Z of FIG. 10, is subject to a negative pressure. If this negative pressure occurs, the direction of the air flowing along the outside curvature wall of the intake port 4 is disturbed and the air will flow into the combustion chamber from a plurality of directions. As opposed to this, as shown in FIG. 1, according to the intake port 2 of the present embodiment, since the most curved wall 8 of the intake port 4 is a flat wall, no negative pressure will arise near the most curved wall 8 or any negative pressure arising will be extremely small and therefore the air flowing along the outside curvature wall of the intake port 4 will not be dispersed and will flow into the combustion chamber 1 as concentrated at a specific region from a single direction along the wall of the combustion chamber 1. Due to this as well, again, the air flows into the combustion chamber 1 in a manner further locally concentrated, so the intake swirl ratio becomes even larger.

In this way, according to the present embodiment, due to the action of the flat bottom wall 6*c* defining the transverse edge 11 and groove 6 and the flat wall 8 of the intake port 4, the air is made to swirl in the combustion chamber 1 by a tumble flow and the intake swirl ratio is also increased. In short, according to the present embodiment, it is possible to increase the intake swirl ratio while maintaining the total amount of the air taken into the combustion chamber 1 large.

In general, in an engine of a type directly injecting fuel into a combustion chamber, the fuel injected into the combustion chamber is hard to uniformly mix with the air taken into the combustion chamber. Therefore, the fuel often is insufficiently burned. As explained above, however, according to the present embodiment, the air taken into the combustion chamber swirls inside the combustion chamber, so the fuel easily is dispersed into the air. Further, according to the present embodiment, the intake swirl ratio is large, so the fuel is more uniformly mixed into the air and burns well. Further, according to the present embodiment, the amount of air taken into the combustion chamber 1 can also be increased. Therefore, according to the present embodiment, the maximum output which the engine can generate is increased.

Further, an engine of a type where the exhaust gas exhausted from the engine is reintroduced in the combustion chamber is known. In this type of engine, the exhaust gas is introduced into the combustion chamber and the action of the inert gas in the exhaust gas is used to lower the combustion temperature of the fuel in the combustion chamber and therefore reduce the amount of nitrogen oxides (NOx) produced in the engine. Further, in this type of engine, the greater the amount of exhaust gas introduced into the combustion chamber, the smaller the amount of NOx produced in the engine. on the other hand, the exhaust gas introduced into the combustion chamber ends up obstructing the combustion of the fuel in the combustion chamber.

If however applying the present invention to this type of engine, even if the amount of exhaust gas introduced into the combustion chamber is large, the fuel in the combustion chamber will be burned well. Therefore, by applying the present invention to this engine, it is possible to burn the fuel in the combustion chamber well and at the same time further reduce the amount of NOx produced in the engine.

Further, an engine of a type having an exhaust purification catalyst for removing harmful components of the exhaust gas arranged in the exhaust passage connected to the engine is known. In general, if the fuel does not burn well in the combustion chamber, even when exhaust gas starts to be emitted from the combustion chamber, the fuel will continue burning and therefore the temperature of the exhaust gas exhausted from the engine will rise. Accordingly, as in the above type of engine, if an exhaust purification catalyst is placed in the exhaust passage, this exhaust purification catalyst will end up being degraded by the heat of the exhaust gas. To keep down this heat degradation of the exhaust purification catalyst, in the above type of engine, the amount of the fuel injected from the fuel injector is made greater than the amount of fuel giving a stoichiometric air-fuel ratio so as to prevent part of the fuel in the combustion chamber from burning and supply this fuel to the exhaust purification catalyst so as to lower the temperature of the catalyst. In this case, the fuel economy becomes worse.

If the present invention is applied to this type of engine, however, the fuel will burn well in the combustion chamber and all of the fuel will end up being burned when exhaust gas starts to be emitted from the combustion chamber, so the temperature of the exhaust gas will be low. Therefore, it is not necessary to increase the amount of fuel injected from the fuel injector in order to lower the temperature of the exhaust purification catalyst, so deterioration of the fuel economy can be suppressed.

Note that in the above embodiment, the distance between the long edges 7*a* and 7*b* gradually becomes greater the closer to the combustion chamber 1, but in some cases it may also be made to gradually become smaller the closer to the combustion chamber 1. Further, it is also possible to alternately arrange regions of long distances between long edges 7*a* and 7*b* and regions of short distances. Further, in the above embodiment, the depth of the groove 6 becomes gradually greater the closer to the combustion chamber 1, but in some cases it may also conversely become smaller the closer to the combustion chamber 1 or may be kept at a constant depth. Further, the area of the groove as viewed in FIG. 2 may be freely set.

Further, the present invention may also be applied to an engine of a type injecting fuel into the intake port. By applying the present invention in this case as well, the fuel burns well in the combustion chamber, so effects similar to the effects obtained from the above embodiment can be obtained.

Figure 13:
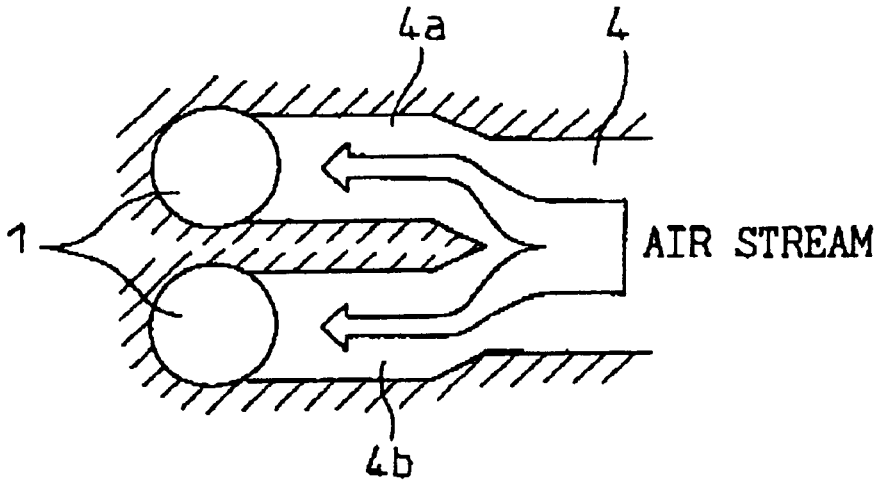
FIG. 13 is a view of a Siamese type intake port.

Note that in an engine of a type injecting fuel into the intake port, sometimes an intake port of the configuration shown in FIG. 13 (so-called "Siamese type intake port") is used. The present invention can also be applied to this case. In this type of intake port, the intake passage 4 branches into two intake branch passages 4*a* and 4*b*. These intake branch passages 4*a* and 4*b* are communicated with the same combustion chamber. Therefore, according to this type of intake port, air (more strictly speaking an air-fuel mixture of fuel and air) flows into the combustion chamber from the two intake branch passages 4*a* and 4*b*.

Figure 14:
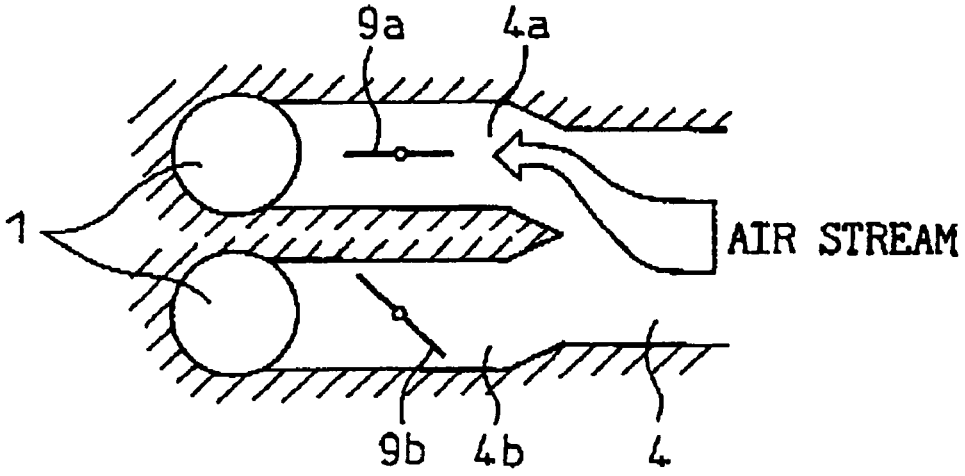
FIG. 14 is a view of another Siamese type intake port.

Further, the present invention can also be applied to the case where an intake port of the configuration shown in FIG. 14 is used in an engine of a type directly injecting fuel into the combustion chamber. By applying the present invention in this case as well, the fuel burns well in the combustion chamber, so effects similar to the effects obtained from the above embodiment can be obtained.

Note that if simply explaining the intake port shown in FIG. 14, in this intake port, the intake passage 4 is branched into two intake branch passages 4*a* and 4*b*. These intake branch passages 4*a* and 4*b* are communicated with the same combustion chamber. Further, these intake branch passages 4*a* and 4*b* have flow regulating valves 9*a* and 9*b* arranged inside them.

In the intake port shown in FIG. 14, by opening one flow regulating valve 9*a* and closing the other flow regulating valve 9*b*, the air flows into the combustion chamber 1 through only the intake branch passage 4*a*. According to this, the air flowing into the combustion chamber 1 swirls inside the combustion chamber 1 by a tumble flow and swirl flow (flow swirling along cylindrically shaped cylinder wall defining part of combustion chamber 1).

While the invention has been described with reference to specific embodiments chosen for purpose of illustration, it should be apparent that numerous modifications could be made thereto by those skilled in the art without departing from the basic concept and scope of the invention.

What is claimed is:

1. An intake port of an internal combustion engine having an intake passage curved to a certain direction and communicated with a combustion chamber of the engine to send air into the combustion chamber, provided with:

a groove provided in a wall at a side near a center of curvature of said intake passage in the wall defining the intake passage and extending along the flow of air in the intake passage, at least one long edge formed by one side wall of the wall defining said groove and the wall adjoining said side wall in the wall defining the intake passage, extending along the flow of air in the intake passage, and projecting out toward the inside of the intake passage, and a bent part provided at the wall of the side near the center of curvature of the intake passage in the wall defining the intake passage in proximity to a line connecting the intake passage and combustion chamber and extending in a horizontal direction with respect to the flow of air in the intake passage.

2. An intake port of an internal combustion engine as set forth in claim 1, wherein the bent part is formed by the boundary of said groove at the combustion chamber side.

3. An intake port of an internal combustion engine as set forth in claim 1, wherein said at least one long edge comprises two long edges formed by the two side walls in the wall defining the groove and the walls adjoining these side walls in the wall defining the intake passage, extending along the flow of air in the intake passage, and projecting out toward the inside of the intake passage and wherein the distance between the long edges at the side near the combustion chamber is longer than the distance between these long edges at the side far from the combustion chamber.

4. An intake port of an internal combustion engine as set forth in claim 1, wherein the bottom wall in the wall defining the groove is flat.

5. An intake port of an internal combustion engine as set forth in claim 1, wherein at least part of the wall at the side far from the center of curvature of the intake passage in the wall defining the intake passage is flat.

6. An intake port having an intake passage for sending air into a combustion chamber of an internal combustion engine and having a long axis of said intake passage extending toward a partial region of the intake port of the combustion chamber opening when an intake valve opens, provided with:

a groove provided in the wall of a side different from a wall facing the partial region of said intake port when viewed along a long axis of said intake passage in the wall defining the intake passage and extending along the flow of air in the intake passage, a long edge formed by one side wall of the wall defining the groove and the wall adjoining said side wall in the wall defining the intake passage, extending along the flow of air in the intake passage, and projecting out toward the inside of the intake passage, and a bent part provided at the wall of the side where said long edge is provided in the wall defining the intake passage in proximity to a line connecting the intake passage and combustion chamber and extending in a horizontal direction with respect to the flow of air in the intake passage.

* * * * *